US006200227B1

(12) United States Patent
Sery

(10) Patent No.: US 6,200,227 B1
(45) Date of Patent: Mar. 13, 2001

(54) POSITIONING AND ALIGNMENT SYSTEM FOR GOLF PUTTERS

(75) Inventor: Joseph Sery, San Diego, CA (US)

(73) Assignee: Carbite, Inc., San Diego, CA (US)

( * ) Notice: Subject to any disclaimer, the term of this patent is extended or adjusted under 35 U.S.C. 154(b) by 0 days.

(21) Appl. No.: 09/329,818

(22) Filed: Jun. 10, 1999

(51) Int. Cl.[7] ..... A63B 69/36; A63B 53/04
(52) U.S. Cl. ..... 473/251; 473/254; 473/252
(58) Field of Search ..... 473/238, 268, 473/242, 252, 251, 313, 324, 282, 253, 254; D21/742, 744, 745, 746, 751

(56) References Cited

U.S. PATENT DOCUMENTS

D. 236,517 8/1975 Cook .
D. 251,027 2/1979 Cruger .
D. 263,409 * 3/1982 Duclos .
D. 307,617 * 5/1990 Boone .
D. 326,131 5/1992 Antonious .
D. 356,844 3/1995 Solheim et al. .
1,433,150 * 10/1922 Reach .
2,003,951 * 6/1935 Pepin .
4,629,193 * 12/1986 Pierman .
5,160,144 * 11/1992 Maniatis .
5,417,429 5/1995 Strand .
5,947,837 * 9/1999 Perry .

* cited by examiner

*Primary Examiner*—Sebastiano Passaniti
(74) *Attorney, Agent, or Firm*—Shawnell Williams, Esq.; Kegler, Brown, Hill & Ritter

(57) ABSTRACT

A golf putter with two reference lines on the top of the putter head and hosel and a reference indicator placed on the putter head below the hosel, all of which improves putting accuracy. The invention aids the golfer in positioning the golf ball in reference to the center of the face of the putter and properly positions the golfer's head and eyes directly above the putter. If the golfer's head and eyes are properly positioned over the putter, the reference lines on top of the putter and hosel will appear to be continuous and the reference indicator is not visible. However, if the golfer's head and eyes are not properly positioned above the putter, the reference lines appear to be discontinuous and/or the reference indicator is seen by the golfer.

3 Claims, 2 Drawing Sheets

POSITIONING AND ALIGNMENT SYSTEM FOR GOLF PUTTERS

BACKGROUND OF THE INVENTION

1. Field of the Invention

This invention relates to a golf putter with two reference lines on the top of the putter head and hosel and a reference indicator on top of the putter head located below the hosel, all of which improves putting accuracy. The invention assists the golfer in positioning the golf ball in reference to the center of the face of the putter and properly positions the golfer's head and eyes directly above the putter.

2. Description of the Prior Art

Since the advent of the game of golf, inventors have been attempting to design golf putters with better aiming means to improve putting accuracy. Examples of these putters include U.S. Pat. No. 5,417,429, Des. 236,517, Des. 251, 027, Des. 326,131 and Des. 356,844. Although prior golf putters have been designed to provide golfers with aiming assistance, none of these putters help in positioning the golfer's head and eyes directly above the center of gravity of the putter which is the optimum position for putting accuracy. Thus, a need exists for a golf putter that improves putting accuracy by positioning the golfer's head and eyes in the proper plane directly above the center of gravity of the putter.

BRIEF SUMMARY OF THE INVENTION

The present invention is a golf putter that improves putting accuracy by using two reference lines on the putter and hosel and a reference indicator on the putter. The two reference lines and reference indicator assists the golfer in positioning his head and eyes directly above the putter for ideal putting position each time the golfer addresses the golf ball. In addition, the invention with the use of the two reference lines aids the golfer in the positioning of the golf ball in reference to the center of the face of the putter.

The two reference lines and reference indicator are uniquely positioned on the invention. The first reference line is placed on top of the putter head. The second reference line is placed on top of the putter's hosel. The reference indicator is located on the top of the putter head just below the hosel. The two reference lines and reference indicator are arranged in such a unique manner that when viewed by the golfer from a position directly above the top centerline of the putter, the two lines appear to be one continuous line and the golfer will not see the reference indicator . However, if the golfer's head and eye position is not directly over the center of gravity of the putter, the two reference lines will appear as two distinct lines and/or the reference indicator is seen by the golfer.

The invention also prevents the golfer from having his or her head and eyes too far above or too far below the center of the putter. If the golfer's head and eyes are too far above the center of the putter, the golfer will see two separate reference lines. If the golfer's head and eyes are too far below the center of the putter, the golfer will see the reference indicator on the putter. Thus, the golfer's putting form will be substantially improved with the use of the present invention resulting in increased putting accuracy.

The present invention also assists the golfer in positioning the golf ball in reference to the center of the face of the putter. The golfer will know that he or she has the golf ball placed in the center of the striking surface of the putter when the ball is within the two reference lines. Therefore, the golfer will know where the golf ball is positioned in relationship to the center of the striking face of the putter for optimum putting accuracy.

An object of this invention is to assist the golfer in properly positioning his or her head and eyes in a plane directly above the center of gravity of the putter for optimum putting accuracy.

Another object of this invention is to aid the golfer in placing the golf ball in relationship to the center of the striking surface of the putter.

This, together with other objects of the invention, will become apparent from the following detailed description of the invention and the accompanying drawings.

DETAILED DESCRIPTION OF THE INVENTION

Figure 3:
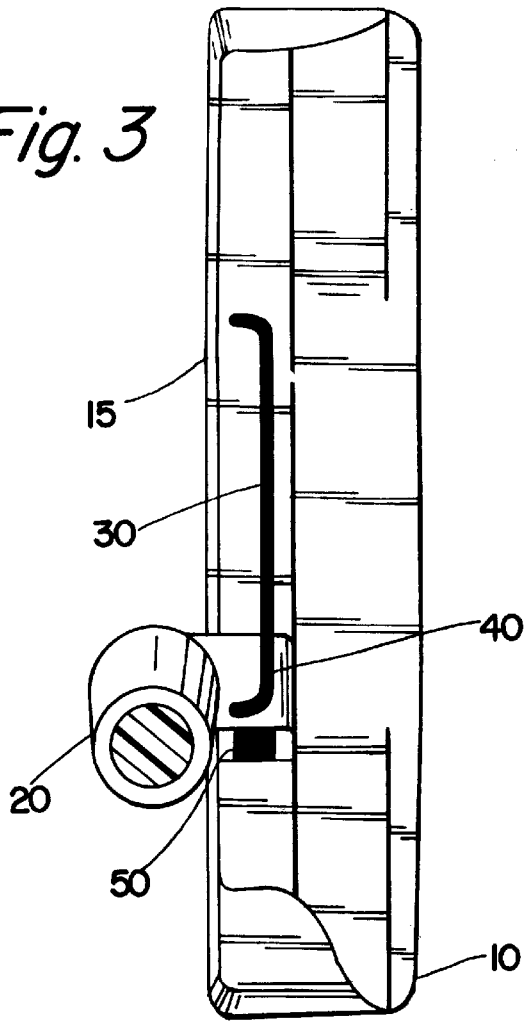
FIG. 3 shows a top view of the putter head and hosel when the golfer's head and eyes are in the same plane above the putter, but below the center of gravity of the putter.

The present invention is a golf putter that improves putting accuracy. The preferred embodiment of the present invention shown in FIG. 1 consists of a putter head 10 and a hosel 20. The putter head 10 includes a planar striking face 15 and a first reference line 30. As shown in FIG. 3, the putter head 10 also includes a reference indicator 50. In addition, the hosel 20 has a second reference line 40.

The invention improves putting accuracy by aiding the golfer in positioning his or her head and eyes to the optimum putting position, directly above the center of gravity of the putter. The invention also assists the golfer in positioning the golf ball in relationship to the center of the striking face 15. These objectives are accomplished with the use of the first and second reference lines 30 and 40 and a reference indicator as disclosed in FIG. 3.

Figure 5:
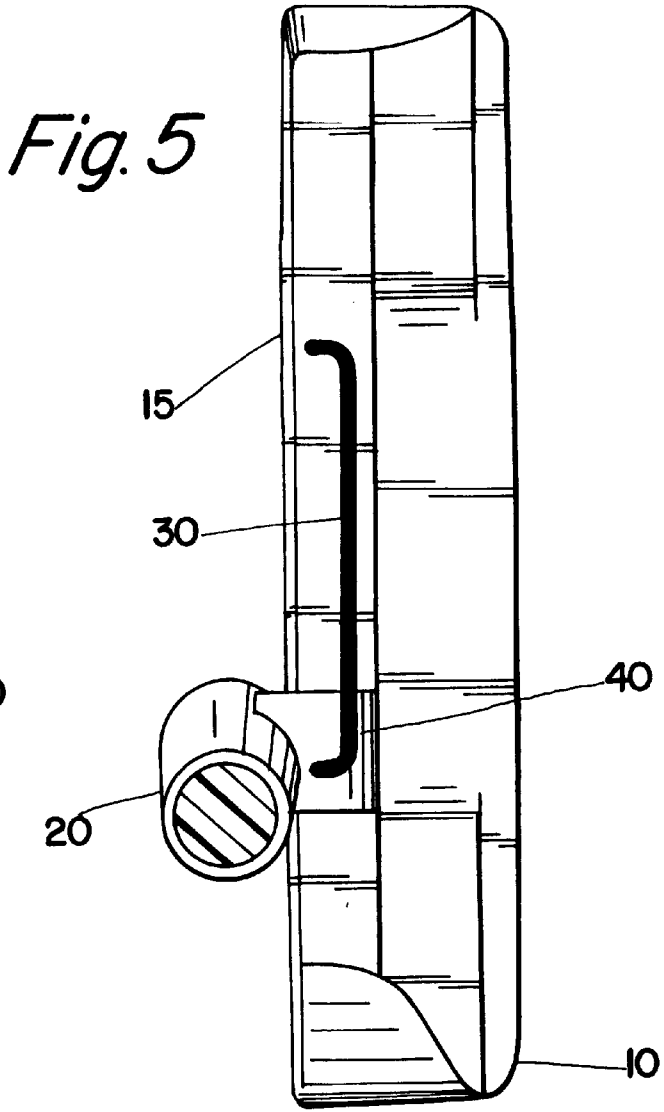
FIG. 5 shows the top view of the putter head and hosel when the golfer's head and eyes are in the same plane directly above the center of gravity of the putter.

The first and second reference lines 30 and 40 and the reference indicator 50 are uniquely positioned on the invention. The first reference line 30 is located on top of the putter head 10. The second reference line 40 is placed on top of the hosel 20. The reference indicator 50 is positioned on top of the putter head 10 just below the hosel 20 which is connected to the putter head 10. The first and second reference lines 30 and 40 and the reference indicator 50 are arranged in such a unique manner that when viewed by the golfer from a position in the same plane directly above the center of gravity of the putter, the first and second reference lines 30 and 40 appear to be one continuous line as shown in FIG. 5. Furthermore, when the golfer's head and eyes are in this ideal putting position, the reference indicator 50 is not visible to the golfer.

Figure 2:
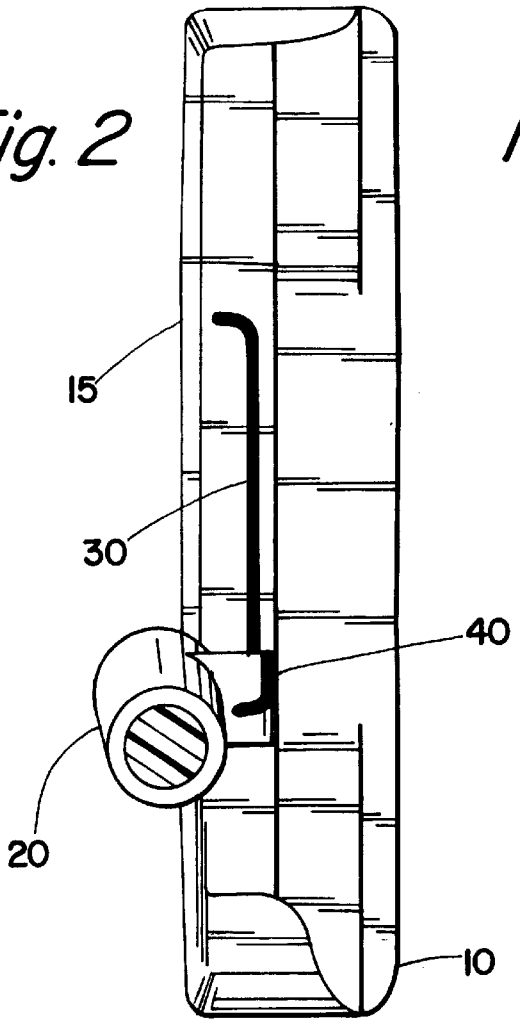
FIG. 2 shows a top view of the putter head and hosel when the golfer's head and eyes are slightly in front of the plane directly above the center of gravity of the putter.
Figure 1:
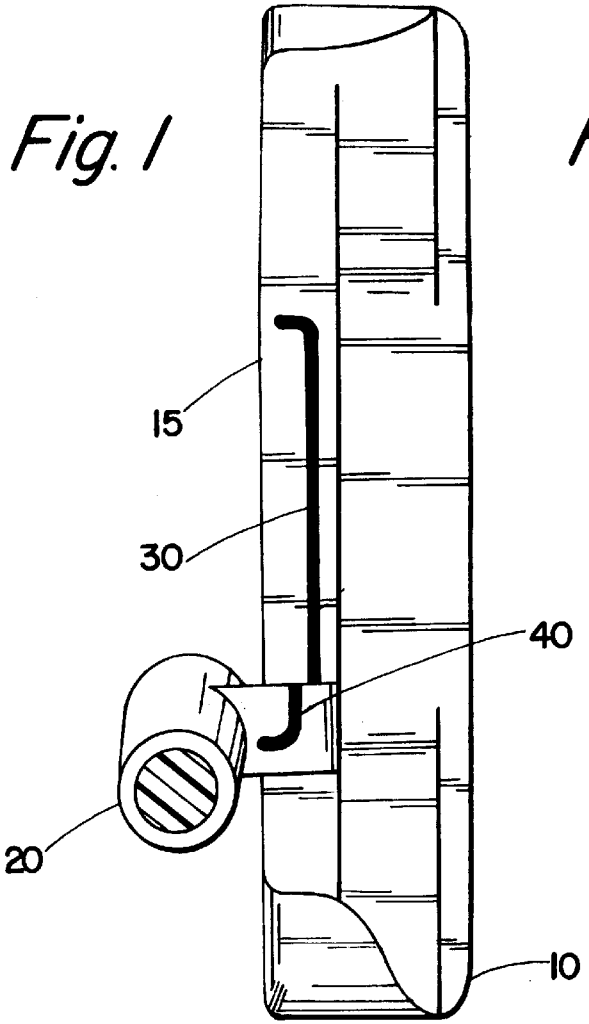
FIG. 1 shows a top view of the putter head and hosel when the golfer's head and eyes are slightly behind the plane directly above the center of gravity of the putter.

However, if the golfer's head and eyes are not positioned in the same plane directly over the center of gravity of the putter head 10, the first and second reference lines 30 and 40 will appear as two distinct lines as shown in FIG. 1 and FIG. 2. If the golfer's head and eyes are not in the same plane and behind the center of gravity of the putter head 10, the first and second reference lines 30 and 40 appear as two separate lines as shown in FIG. 1. The second reference line 40 on top of the hosel 20 appears to be in front of the first reference line 30 located on the putter head 10. If the golfer's head and eyes are positioned in front of the center of gravity of the putter head 10 as illustrated in FIG. 2, the second reference line 40 appears to be behind the first reference line 30.

Figure 4:
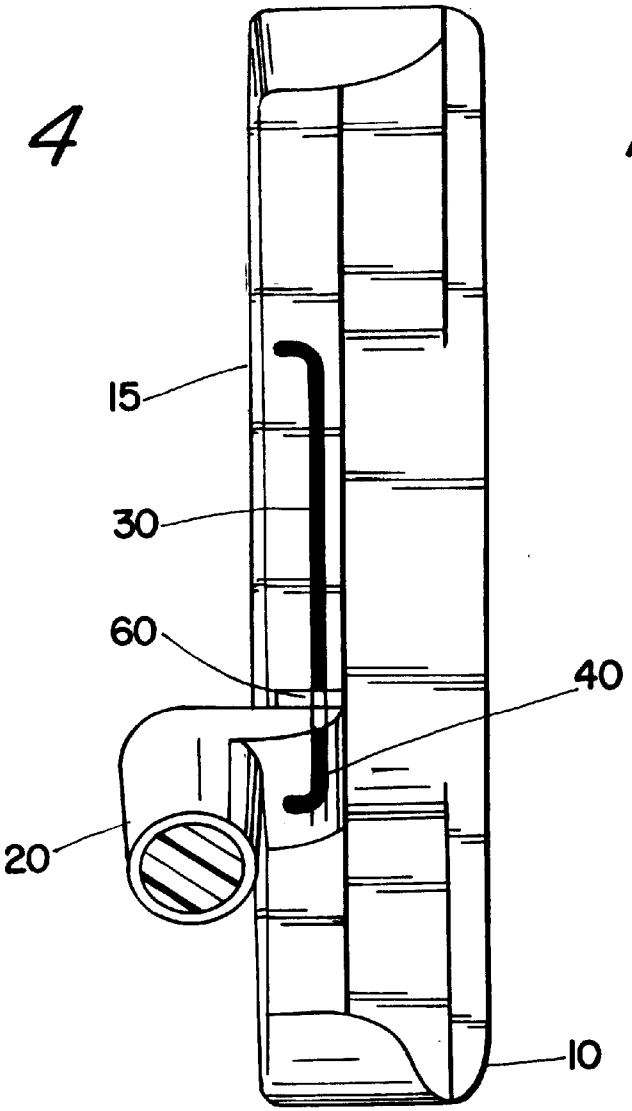
FIG. 4 shows a top view of the putter head and hosel when the golfers head and eyes are in the same plane above the putter, but above the center of gravity of the putter.

In addition to ensuring that the golfer's head and eyes are in the same plane as the center of gravity of the putter, the invention also prevents the golfer from having his or her head and eyes too far above or below the center of gravity of the putter head 10. If the golfer's head and eyes are below the center of gravity of the putter head 10 as shown in FIG. 3, the reference indicator 50 is visible to the golfer. However, if the golfer's head and eyes are above the center of gravity of the putter head 10 as demonstrated in FIG. 4, the golfer will see a gap 60 between the first and second reference lines 30 and 40. This gap 60 is the side of the hosel 20 which is visible to the golfer when his or her head and eyes are not positioned directly over the center of the putter head 10. Thus, with the aid of this invention, the golfer will clearly see two distinct and separate reference lines 30 and 40 and/or a reference indicator 50 when his or her head and eyes are not in the correct putting position.

Another aspect of the invention is its ability to assist the golfer in positioning the golf ball in relationship to the center of the planar striking face 15. In the preferred embodiment, the first and second reference lines 30 and 40 indicate the center of the planar striking face 15. Therefore, the first and second reference lines 30 and 40 allows the golfer to position the golf ball within or outside the center of the planar striking face 15 which improves putting control.

While this invention has been shown and described with respect to a detailed embodiment thereof, it will be understood by those skilled in the art that various changes in form and detail thereof may be made without departing from the scope of the claims of the invention.

What is claimed is:

1. A putter head for a golf putter, comprising:

(a) a planar striking face;

(b) a hosel;

(c) a first reference line located across the top of said head, wherein the major portion of said first reference line is parallel to said planar striking face; and (d) a separate second reference line located across the top of said hosel, wherein the major portion of said second reference line is parallel to said planar striking face, and when viewed from above in connection with said first reference line from the same plane, said first reference line and said second reference line appear to be one continuous line which indicates the user's head is in the optimum putting position.

2. The putter head according to claim 1, further comprising a reference indicator positioned on top of said putter head and below said hosel.

3. The putter head according to claim 1, wherein said first reference line and said second reference line designate the center of said planar striking face.

* * * * *